US009334448B2

(12) United States Patent
Stark et al.

(10) Patent No.: US 9,334,448 B2
(45) Date of Patent: May 10, 2016

(54) METHOD FOR REDUCING HYDROGEN SULFIDE EVOLUTION FROM ASPHALT AND HEAVY FUEL OILS

(71) Applicant: BAKER HUGHES INCORPORATED, Houston, TX (US)

(72) Inventors: Joseph L. Stark, Richmond, TX (US); Jennifer D. Draper, Bryan, TX (US); Paul J. Biggerstaff, Sugar Land, TX (US); Donald L. Wolfe, Baden, PA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/681,605

(22) Filed: Apr. 8, 2015

(65) Prior Publication Data

US 2015/0210928 A1 Jul. 30, 2015

Related U.S. Application Data

(63) Continuation of application No. 13/654,124, filed on Oct. 17, 2012, now Pat. No. 9,068,128.

(60) Provisional application No. 61/548,554, filed on Oct. 18, 2011.

(51) Int. Cl.

| | |
|---|---|
| ***C10G 29/16*** | (2006.01) |
| ***C10G 29/04*** | (2006.01) |
| ***C10G 29/06*** | (2006.01) |
| ***C10G 29/10*** | (2006.01) |
| ***C10C 3/02*** | (2006.01) |
| ***C10G 29/00*** | (2006.01) |
| *B01D 15/00* | (2006.01) |
| *B01D 15/02* | (2006.01) |
| *B01D 15/08* | (2006.01) |

(52) U.S. Cl.

CPC ..... *C10C 3/023* (2013.01); *C10C 3/026* (2013.01); *C10G 29/00* (2013.01); *C10G 29/04* (2013.01); *C10G 29/06* (2013.01); *C10G 29/10* (2013.01); *C10G 2300/207* (2013.01)

(58) Field of Classification Search

CPC ..... C10G 29/04; C10G 29/06; C10G 29/10; C10G 29/16; B01D 15/00; B01D 15/02; B01D 15/08

See application file for complete search history.

(56) References Cited

U.S. PATENT DOCUMENTS

| | | | | |
|---|---|---|---|---|
| 4,732,888 | A | 3/1988 | Jha et al. | |
| 5,182,013 | A * | 1/1993 | Petersen et al. | 208/348 |
| 5,264,187 | A | 11/1993 | Olbrich et al. | |
| 5,276,172 | A | 1/1994 | Tate et al. | |
| 5,462,721 | A * | 10/1995 | Pounds et al. | 423/226 |
| 6,245,221 | B1 | 6/2001 | Baird, Jr. et al. | |
| 6,444,117 | B1 * | 9/2002 | Khan et al. | 208/189 |
| 6,710,091 | B1 | 3/2004 | Womelsdorf et al. | |
| 8,034,231 | B2 | 10/2011 | Draper | |
| 9,068,128 | B2 | 6/2015 | Stark et al. | |
| 2005/0241991 | A1 | 11/2005 | Lott et al. | |
| 2006/0116450 | A1 | 6/2006 | Buras et al. | |
| 2007/0119747 | A1 | 5/2007 | Harrell et al. | |
| 2008/0217008 | A1 | 9/2008 | Langdon et al. | |
| 2009/0145330 | A1 | 6/2009 | Draper et al. | |
| 2009/0206003 | A1 | 8/2009 | Draper | |
| 2010/0101416 | A1 | 4/2010 | Akiyama | |
| 2011/0155643 | A1 * | 6/2011 | Tov et al. | 208/119 |
| 2012/0152857 | A1 | 6/2012 | Yang et al. | |

FOREIGN PATENT DOCUMENTS

| | | | | |
|---|---|---|---|---|
| CN | 101076558 | A | 11/2007 | |
| CN | 101945934 | A | 1/2011 | |
| JP | 48-17446 | * | 5/1973 | C10L 1/30 |
| KR | 1020090067856 | A | 6/2009 | |
| WO | 2005065177 | A2 | 7/2005 | |
| WO | 2009076420 | A1 | 6/2009 | |
| WO | 2009105444 | A2 | 8/2009 | |

OTHER PUBLICATIONS

Satterfield, C.N., "Heterogeneous Catalysis in Practice," McGraw-Hill, pp. 25-26 (1980).

Matsuda, S. et al., "Adsorption and Oxidative Desorption of Hydrogen Sulfide by MoO3—TiO2," Ind. Engr. Chem. Fundam. 21, pp. 18-22 (1982).

Int'l Search Report in PCT/US2012/060813 dtd Mar. 29, 2013.

* cited by examiner

*Primary Examiner* — Brian McCaig

(74) *Attorney, Agent, or Firm* — Mossman Kumar & Tyler PC

(57) ABSTRACT

Hydrogen sulfide evolution from asphalt or heavy fuel oil may be reduced or eliminated using an additive to act as a scavenger. Zinc, in conjunction with an additional metal selected from Fe, Mn, Co, Ni, Cr, Zr, when present in the form of nano-particles of an oxide, borate or carboxylate is an effective component is preventing or mitigating the evolution of hydrogen sulfide. The nano-particles may be used neat or as a dispersion. These metals may also be complexed and used in the form of a solution. Molybdenum, when used with one or both of Fe and Zn is also a useful in any of these forms for the same purpose.

17 Claims, No Drawings

METHOD FOR REDUCING HYDROGEN SULFIDE EVOLUTION FROM ASPHALT AND HEAVY FUEL OILS

CROSS REFERENCE TO RELATED APPLICATIONS

This application is a Continuation Application and claims priority to U.S. application Ser. No. 13/654,124 filed on Oct. 17, 2012, which has issued Jun. 30, 2015 as U.S. Pat. No. 9,068,128; which claims priority to U.S. Provisional Application Ser. No. 61/548,554 filed on Oct. 18, 2011; all of which are incorporated by reference herein in their entirety.

BACKGROUND OF THE INVENTION

1. Field of the Invention

This invention relates to asphalt and heavy fuel oil production techniques. This invention particularly relates to asphalt and heavy fuel oil production employing chemical additives.

2. Background of the Art

"Kerogen" is generally defined in the art of hydrocarbon production as a solid, insoluble hydrocarbon that has been converted by natural degradation (e.g., by diagenesis) and that principally contains carbon, hydrogen, nitrogen, oxygen, and sulfur. Coal and oil shale are typical examples of materials that contain kerogens. "Bitumen" is generally defined in the art as a non-crystalline solid or viscous hydrocarbon material that is substantially soluble in carbon disulphide.

"Oil" is generally defined as a fluid containing a complex mixture of hydrocarbons. During a refining process, oil is converted into a number of products. For example, gasoline is one such product and is a mixture of low viscosity and volatile hydrocarbons. Lubricating oil is another hydrocarbon product and has higher viscosity and lower volatility. It is usually very pure and has a very low amount of corrosive materials.

Fuel oils, on the other hand, tend to be products produced by first removing the premium components such as those just listed from crude oil. The residual products are then subjected to processes such as cracking to produce more of the premium products. Finally, when it becomes uneconomical to further treat the residue, they are then sold according to their viscosity and other physical properties.

The ASTM (American Society for Testing and Materials) employs six grades for characterizing fuel oils. Heavy fuel oils are those in grades 4, 5 and 6. Grade 4 is typical commercial fuel oil and can often be used in burners without the need for preheating. Grade 5 fuel oils are typically higher in viscosity and lower in volatility and are sometimes referred to as "Bunker B" while the very heavy fuel oils in Grade 6, such as "Bunker C," have even greater viscosity and lower volatility.

The heavy and especially the very heavy fuel oils are often employed in applications where high viscosity can be tolerated and the use of preheating can be employed. For examples. Bunker C is often used in large ships. Bunker B is sometimes employed in applications that would otherwise burn coal. Any of these grades, but especially the Bunker B and C oils, is likely to contain a substantial amount of sulfur and sulfur compounds.

Materials which are even higher in viscosity and lower in volatility than fuel oils, but are not a solid such as coke, are often also referred to in the art as bitumen or asphalt and further include many of the non-hydrocarbon components of oil, including elemental sulfur and sulfur containing compounds. These bitumen and bitumen like products have a surprising number of uses including but not limited to membranes useful for waterproofing roofs, shingle construction, and road construction. Heavy fuel oils, on the other hand, are often employed in applications where high viscosity can be tolerated and the use of preheating can be employed.

Hydrogen sulfide, a sulfur bearing compound, may be a safety and environmental concern to the petroleum industry. Vacuum tower bottoms (VTB) used in the production of bitumen and heavy fuel oil often contain high levels of hydrogen sulfide that pose significant danger to individuals involved in its production and handling. While hydrogen sulfide is often removed from refined fuels by refinery processes, less valuable products used for fuel oil and asphalt production sometimes do not receive additional processing to remove hydrogen sulfide. Hydrogen sulfide levels in such products can be aggravated by the high temperatures (sometimes above 300° F.) as these temperatures may generate additional hydrogen sulfide from the cracking of sulfur compounds inherent in the heavy oil.

The reduction of hydrogen sulfide in asphalt and heavy fuel oil is therefore an important consideration that presents unique challenges to the petroleum refining industry.

SUMMARY OF THE INVENTION

In one aspect, the invention is a method for reducing hydrogen sulfide emissions from heavy fuel oil or an asphalt composition including admixing an additive with the heavy fuel oil or asphalt composition wherein the additive comprises nano-particles of a zinc carbonate, oxide, or sulfide and a metal carbonate, oxide, or sulfide wherein the metal is selected from the group of consisting of Fe, Mn, Co, Ni, Cr, Zr, and combinations thereof. The non-zinc metal component of the additive may be present at from about 1 to about 50 molar % and be substantially as effective at reducing hydrogen sulfide as an additive containing Zn exclusively.

In still another aspect, the invention is a method for reducing hydrogen sulfide emissions from heavy fuel oil or an asphalt composition including admixing an additive with the heavy fuel oil or asphalt composition wherein the additive comprises nano-particles of Mo or Co boroacylate, carboxylate, and oxide, and, optionally, a member selected from the group consisting of boroacylates carboxylates, and oxides of Fe, Zn, and combinations thereof.

In another aspect, the invention is a method for reducing hydrogen sulfide emission from heavy fuel oil or an asphalt composition including admixing an additive with a heavy fuel oil or asphalt composition wherein the additive comprises a solution or dispersion of zinc oxide, sulfide, boroacylate, or carbonate and a metal oxide, sulfide, boroacylate, or carbonate selected from the group of consisting of an oxide, sulfide, boroacylate, or carbonate of Fe, Bi, Mn, Co, Ni, Cr, Zr, and combinations thereof. The non-zinc metal component of the additive may be present at from about 1 to about 50 molar % and be substantially as effective at reducing hydrogen sulfide as an additive containing Zn exclusively.

In still another aspect, the invention is a method for reducing hydrogen sulfide emission from heavy fuel oil or an asphalt composition including admixing an additive with a heavy fuel oil or asphalt composition wherein the additive comprises a solution or dispersion of Mo or Co boroacylates, carboxylates, and oxides, and, optionally, a member selected from the group consisting of boroacylates carboxylates, and oxides of Fe, Zn, and combinations thereof.

In another aspect, the invention is a method for reducing hydrogen sulfide emission from heavy fuel oil or an asphalt composition including admixing an additive with a heavy fuel oil or asphalt composition wherein the additive comprises a solution or dispersion of Bi boroacylates, carboxylates, and oxides, and, optionally, a member selected from the group consisting of bismuth acrylates, carboxylates, and oxides of Fe, Zn, and combinations thereof.

DETAILED DESCRIPTION OF THE PREFERRED EMBODIMENT

In one embodiment, the disclosure includes a method of reducing hydrogen sulfide emissions from an asphalt or heavy fuel oil composition. For the purposes of this application, the term "asphalt" refers to any of a variety of materials that are solid or semisolid at 25° C. and which may gradually liquefy when heated, and in which the predominant constituents are naturally occurring bitumens (or kerogens) or which are bitumen like materials obtained as residues in, for example, petroleum refining.

Similarly, for the purposes of this application, a heavy fuel oil is any fuel oil coming within the specifications of ASTM grades 4-6. In one embodiment, the heavy fuel oil treated according to the method of the application is one within grades 5 and 6. In still another embodiment, the method is used with grade 6 only.

Hydrogen sulfide may be present in asphalt and heavy fuel oil as a naturally occurring material, especially in asphalts derived from kerogens. Oil which is heavily contaminated with sulfur, sometimes referred to in the art as sour crude, may also produce bottoms of fuel oil and/or asphalts that have carried over hydrogen sulfide. Any such material which has a sulfur component may spontaneously emit hydrogen sulfide produced by heating the asphalt. For examples, heating during refining, such as in a distillation unit or within a cracking unit may cause the production of hydrogen sulfide from materials already present such as elemental sulfur.

In one embodiment, hydrogen sulfide present in asphalt and fuel oil is "scavenged" using a method including admixing an additive with the fuel oil or asphalt. For the purposes of the present application, the term scavenging means that an additive interacts with hydrogen sulfide in fuel oil or asphalt such that gaseous emissions of hydrogen sulfide from the asphalt are mitigated or eliminated. Further, also for the purposes of this application, such scavenging may occur immediately after heavy fuel oil or bitumen has undergone cracking or at any point after cracking in processes wherein the heavy fuel oil or bitumen is subjected to cracking. In processes wherein no cracking occurs, then scavenging using the method of the application may be employed when a final or intermediate hydrocarbon stream reaches a point wherein it has physical properties within the ranges of ASTM Fuel Oil grades 4, 5 or 6.

The additives of the invention may include nano-particles of metal oxides, carbonate, or sulfide. These nano-particles may be from 5 to about 300 nm in their largest dimension, often a diameter. In some embodiments, the nano-particles may have a largest dimension of from about 50 to about 250 nm. In still other embodiments, the largest dimension of the nano-particles may be from about 100 to about 200 nm.

The metal bearing nano-particles of the disclosure may be made using any method known to those of ordinary skill in the art of preparing such materials to be useful. For example, in the case of ZnO, the particles may be prepared by basic hydrolysis of at least one zinc compound in alcohol or an alcohol/water mixture. In such a method, the hydrolysis is carried out with sub-stochiometric amounts of base, based on the zinc compound. The precipitate which originally forms during hydrolysis is left to mature until the zinc oxide has completely flocculated. This precipitate is then thickened to give a gel and separated off from the supernatant phase. Such a method is disclosed in U.S. Pat. No. 6,710,091, the contents of which are fully incorporated herein by reference. In another embodiment, the nano-particles may be prepared by other more conventional methods such as cryo-grinding and the like.

Similarly, the other metal bearing nanoparticles components may be prepared using any method known to be useful to those of ordinary skill in the art, either now known or later discovered.

The additives of the method of the application, in some embodiments, may include metal borate complexes also known in the art as boroacylates. The metal borate complexes may be prepared using both borate compounds and non-borate compounds that may form complexes with the metals useful with the method of the application. The borate compounds that may be used include compounds that may be converted insitu to borate compounds that are capable of forming complexes. Exemplary borate compounds may include, but are not limited to, sodium tetraborate, boric acid, disodium octaborate tetrahydrate, sodium diborate, ulexite, and colemanite. Combinations of these materials may also be used.

The metal borate complexes may be made using any method known to be useful in the art of preparing such compositions to be useful. For example, one or more organic acids can be admixed with a metal hydroxide to produce a first admixture which may then be admixed with boric acid to produce such complexes. Other intermediates using differing synthetic paths may also be used so long as the resultant products have a general structure wherein materially all of the resultant composition has a bond or coordination ligand between the boron and the metal. In some embodiments, this is in the form of a "M-O—B" group wherein "M" is a metal, "O" is oxygen and "B" is boron. U.S. Pat. No. 5,276,172, which is fully incorporated herein by reference, teaches one such synthetic route.

Molybdenum, in one embodiment of the method of the application is particularly useful when combined with Fe and/or Zn. It may be used as a nano or macro particle, or in some embodiments, as a solution or dispersion. It is especially useful when solvated using a chelating solvent or a chelating agent that results in a soluble complex.

Cobalt, in one embodiment of the method of the application is particularly useful when combined with Fe and/or Zn. It may be used as a nano or macro particle, or in some embodiments, as a solution or dispersion. It is especially useful when solvated using a chelating solvent or a chelating agent that results in a soluble complex.

Bismuth, in one embodiment of the method of the application is particularly useful when combined with Fe and/or Zn. It may be used as a nano or macro particle, or in some embodiments, as a solution or dispersion. It is especially useful when solvated using a chelating solvent or a chelating agent that results in a soluble complex.

The additives of the application may be prepared in any form/phase that permits their introduction into a heavy fuel oil and/or bitumen. For example, when in the form of a macro or nanoparticles, the particles may be used neat, but may also be dispersed in a carrier fluid such as hexane, benzene, kerosene, or in some embodiments, even water.

The oxides, borates, and carboxylates may be prepared using complexing agents that render the complexed compositions soluble. Suitable solvent that may be used to prepare the additives of the application include, but are not limited to alcohols, glycols, ethers, polyethers and the like.

The additives may be admixed with an asphalt using any method known to be useful to those of ordinary skill in the art. For example, the additive may be introduced into a vessel and then asphalt introduced into the vessel "on top" of the additive and then mixed using a mechanical mixer. In an alternative embodiment, the additive and asphalt are not mixed using a mechanical mixer but rather are admixed by moving the vessel. In still another embodiment, the additive may be introduced as a feed stream into a bottoms separation process in an oil refinery. The additives may be added to asphalt when it is being stored or transported; for example the additives may be introduced in to a storage tank or the hold of a ship either before, during or after asphalt or heavy fuel oil is introduced.

The additive may be introduced into heavy fuel oil or asphalt at any concentration useful to the intended end result. For example, if complete reduction of hydrogen sulfide is not needed, then the additive may be introduced at a level sufficient to reach a target specification. Those of ordinary skill in the art well know how to determine the appropriate concentration of additive to use to reach a target or specification hydrogen sulfide concentration. Generally though, it may be desirable in some embodiments of the invention to use sufficient additive to introduce from about 20 to 2500 ppm by weight metal oxide, carboxylate, borate, sulfide, carbonate, boroacylate, or acrylate into the asphalt or fuel oil. In other embodiments, the concentration may be from 500 to 2000 ppm. In still other embodiments, the concentration may be from about 1000 to 1500 ppm. Different asphalts and fuel oils and even similar asphalts fuel oils having differing initial hydrogen sulfide concentrations may require different loadings of the additives of the invention.

The additives of the invention, in some applications, may be most effective when allowed to interact with a heavy fuel oil or bitumen over a period of time. For example, in one embodiment, once admixed with asphalt or heavy fuel oil, the additives of the application may most effectively reduce hydrogen sulfide concentration within the asphalt over the course of a period of from 1 hour to about 4 days.

The additives of the disclosure may be used at comparatively high temperatures. For example, the additives may be used at temperatures of 425° F. (218° C.) but are also, in some embodiments, effective at temperatures in the range of 275° F. to 375° F. (135° C. to 190° C.) which is a more commonly used temperature for handling asphalt.

It has been surprisingly discovered that Zn can be combined with other metals in hydrogen sulfide scavengers and yet and be substantially as effective at reducing hydrogen sulfide as an additive containing Zn exclusively. In some embodiments, this result may be observed when the molar ratio of Zn to the other metal is from about 1:1 to 20:1 (Zn: Fe, Mn, Co, Ni, Cr, and/or Zr). In other embodiments, the ratio is from about 2:1 to 10:1, and in still other embodiments, the ratio is from about 3:1 to 5:1.

EXAMPLES

The following hypothetical example is provided to illustrate the invention. The examples are not intended to limit the scope of the invention and they should not be so interpreted. Amounts are in weight parts or weight percentages unless otherwise indicated.

Example 1

Quart cans of asphalt are collected for tested. Controls are tested by puncturing the can and inserting a DRAGER® Hydrogen Sulfide tube and measuring the concentration of hydrogen sulfide within the can. Other cans are treated with the additives shown below, shaken 50 times, and then heated at from about 300 to about 400° F. for the time period shown below in Table 1. These samples are then tested using the same procedure as for the control. The materials used are: Zinc Carbonate (22.4% Zn); Zinc Octoate (23% Zn); Zinc & Iron Octoate (5.3% Fe: 7.7% Zn); Zinc & Cobalt Octoate (10% Zn: 10% Co); Zinc & Boron Octoate (23% Zn); and Iron & Cobalt Octoate (7% Fe: 7% Co).

TABLE 1

| Sample ID | Dosage | Heating Duration Hours | % Reduction of $H_2S$ |
|---|---|---|---|
| 1-A: Zinc Carbonate | 300 | 4 | 91 |
| | 600 | 4 | 95 |
| | 300 | 24 | 97 |
| 1-B Zinc Octoate | 300 | 4 | 99 |
| | 600 | 4 | 100 |
| | 300 | 24 | 97 |
| 1-C Zinc &Iron Octoate | 300 | 4 | 98 |
| | 600 | 4 | 99 |
| | 300 | 24 | 93 |
| 1-D Zinc & Cobalt Octoate | 300 | 4 | 99 |
| | 600 | 4 | 100 |
| | 300 | 24 | 97 |
| 1-E Zinc & Boron Octoate | 300 | 4 | 96 |
| | 600 | 4 | 100 |
| | 300 | 24 | 93 |

Example 2

Inhibitors are tested by saturating a hydrocarbon with hydrogen sulfide and the preparing a test solution using dilution. After the hydrocarbon has equilibrated, the additive is introduced into the hydrocarbon. The hydrogen sulfide in the vapor phase above the hydrocarbon is the tested using a gas chromatograph. Results are shown below in Table 2. The sample is tested after 60 minutes. The samples tested are Zinc Octoate alone, Zinc Octoate at 270 ppm, 9:1 ratio of Zinc Octoate to Bismuth Octoate (2.8% Bi); 9:1 ratio of Zinc Octoate to Molybdenum Octoate (1.8% Mo);

TABLE 2

| Sample ID | Activity | Reduction in Hydrogen Sulfide Concentration % |
|---|---|---|
| 300 ppm | | |
| 2-A: Zinc Octoate | 18 | 53 |
| 2-B: Zinc Octoate (90% of sample size from 2-A) | — | 47 |
| 2-C: 90:10 Zn Octoate/Bi Octoate | — | 59 |
| 2-D: 90:10 Zn Octoate/Mo Octoate | | 51 |
| 2-E: 90:10 Zn Octoate/Cu Naphthenate | | 54 |
| 600 ppm | | |
| 2-F: 90:10 Zn Octoate/Bi Octoate | | 89 |
| 2-G: 90:10 Zn Octoate/Mo Octoate | | 87 |
| 2-H: 90:10 Zn Octoate/Cu Naphthenate | | 87 |

What is claimed is:

1. A method comprising:

admixing an additive with heavy fuel oil or an asphalt composition wherein the additive comprises nano-particles of a cobalt component selected from the group consisting of Co boroacylate, Co carboxylate, Co oxide, and combinations thereof; wherein the nano-particles are from about 5 to about 300 nm; and once admixed, reducing an amount of hydrogen sulfide emissions from the heavy fuel oil or the asphalt composition over a period of from about 1 hour to 4 days.

2. The method of claim 1 wherein the additive is present at a concentration sufficient to introduce from about 20 to 2500 ppm by weight Co oxide, Co carboxylate, or Co boroacylate into the heavy fuel oil or the asphalt.

3. The method of claim 1 wherein the additive is present at a concentration sufficient to introduce from about 500 to 2000 ppm by weight Co oxide, Co carboxylate, or Co boroacylate into the heavy fuel oil or the asphalt.

4. The method of claim 1 wherein the nano-particles are from about 100 to about 300 nm.

5. The method of claim 1 wherein the nano-particles are from about 100 to about 200 nm.

6. The method of claim 1 wherein the cobalt component selected from the group consisting of Co boroacylate, Co carboxylate, and combinations thereof.

7. The method of claim 1 wherein the method comprises admixing the additive with an asphalt composition.

8. A method comprising:

admixing an additive with heavy fuel oil or an asphalt composition wherein the additive comprises nano-particles of a cobalt component selected from the group consisting of Co boroacylate, Co carboxylate, Co oxide, and combinations thereof; wherein the nano-particles are from about 100 to about 300 nm, wherein the additive is present at a concentration sufficient to introduce from about 20 to 2500 ppm by weight Co oxide, Co carboxylate, or Co boroacylate into the heavy fuel oil or the asphalt; and once admixed, reducing an amount of hydrogen sulfide emissions from the heavy fuel oil or the asphalt composition over a period of from about 1 hour to 4 days.

9. The method of claim 8 wherein the additive is present at a concentration sufficient to introduce from about 500 to 2000 ppm by weight Co oxide, Co carboxylate, or Co boroacylate into the heavy fuel oil or the asphalt.

10. The method of claim 8 wherein the nano-particles are from about 100 to about 200 nm.

11. The method of claim 8 wherein the cobalt component selected from the group consisting of Co boroacylate, Co carboxylate, and combinations thereof.

12. The method of claim 8 wherein the method comprises admixing the additive with an asphalt composition.

13. A method comprising:

admixing an additive with heavy fuel oil or an asphalt composition wherein the additive comprises nano-particles of a cobalt component selected from the group consisting of Co boroacylate, Co carboxylate, and combinations thereof; wherein the nano-particles are from about 5 to about 300 nm, wherein the additive is present at a concentration sufficient to introduce from about 20 to 2500 ppm by weight, Co carboxylate, Co boroacylate, or mixtures thereof into the heavy fuel oil or the asphalt; and once admixed, reducing an amount of hydrogen sulfide emissions from the heavy fuel oil or the asphalt composition over a period of from about 1 hour to 4 days.

14. The method of claim 13 wherein the additive is present at a concentration sufficient to introduce from about 500 to 2000 ppm by weight Co carboxylate, or Co boroacylate into the heavy fuel oil or the asphalt.

15. The method of claim 13 wherein the nano-particles are from about 100 to about 300 nm.

16. The method of claim 13 wherein the nano-particles are from about 100 to about 200 nm.

17. The method of claim 13 wherein the method comprises admixing the additive with an asphalt composition.

* * * * *